US005378538A

United States Patent [19]

Makino et al.

[11] Patent Number: 5,378,538

[45] Date of Patent: Jan. 3, 1995

[54] AROMATIC POLYAMIDE FLAT YARN

[75] Inventors: Osamu Makino, Matsuyama; Michikage Matsui, Katano, both of Japan

[73] Assignee: Teijin Limited, Osaka, Japan

[21] Appl. No.: 104,105

[22] PCT Filed: Dec. 18, 1992

[86] PCT No.: PCT/JP92/01649

§ 371 Date: Aug. 12, 1993

§ 102(e) Date: Aug. 12, 1993

[87] PCT Pub. No.: WO93/12274

PCT Pub. Date: Jun. 24, 1993

[30] Foreign Application Priority Data

Dec. 18, 1991 [JP] Japan ..... 3-353177

[51] Int. Cl.[6] ..... D02G 3/00

[52] U.S. Cl. ..... 428/364; 428/395; 428/397; 428/357

[58] Field of Search ..... 428/364, 395, 357, 397; 528/184, 337, 332

[56] References Cited

U.S. PATENT DOCUMENTS

| | | | |
|---|---|---|---|
| 3,597,393 | 8/1971 | Bach et al. | 528/184 |
| 3,738,964 | 6/1973 | Dobinson et al. | 528/184 |
| 3,801,545 | 4/1974 | Kunzel et al. | 528/184 |
| 4,075,172 | 2/1978 | Ozawa et al. | 264/184 |
| 4,368,615 | 1/1983 | Lammers | 428/364 |
| 4,511,623 | 4/1985 | Yoon et al. | 428/364 |
| 4,622,265 | 11/1986 | Yoon et al. | 428/364 |
| 4,670,343 | 6/1987 | Makino et al. | 428/364 |
| 4,751,760 | 6/1988 | Norota | 428/364 |
| 4,967,548 | 11/1990 | Fangeat et al. | 428/364 |
| 4,994,323 | 2/1991 | Lee | 428/364 |
| 5,246,735 | 9/1993 | Takata et al. | 428/395 |
| 5,246,776 | 9/1993 | Meraldi et al. | 428/364 |

FOREIGN PATENT DOCUMENTS

| | | |
|---|---|---|
| 55-11769 | 3/1980 | Japan . |
| 63-315685 | 12/1988 | Japan . |
| 1139808 | 6/1989 | Japan . |
| 2216276 | 8/1990 | Japan . |
| 59867 | 1/1993 | Japan . |
| 49100322 | 9/1994 | Japan . |
| 1501948 | 2/1978 | United Kingdom . |

*Primary Examiner*—N. Edwards
*Attorney, Agent, or Firm*—Burgess, Ryan and Wayne

[57] ABSTRACT

An aromatic polyamide flat filament useful for producing a twisted yarn having a high utilization of tensile strength thereof, has a flatness of cross-sectional profile thereof of 1.5 to 5, an individual filament thickness of 1 denier or more but less than 50 deniers, a tensile strength of 18 g/denier or more, an ultimate elongation of 3.5% or more, and a Young's modulus of 400 g/denier or more.

2 Claims, No Drawings

AROMATIC POLYAMIDE FLAT YARN

TECHNICAL FIELD

The present invention relates to an aromatic polyamide flat filament. More particularly, the present invention relates to an aromatic polyamide filament having a flat cross-sectional profile and useful for filament products made from yarns having a high twist number, especially for industrial use, for example, ropes, hoses and belts.

BACKGROUND ART

Para-oriented aromatic polyamide filaments have an excellent dynamic performance and thus are widely used as industrial filaments for various uses. However, the p-type aromatic polyamide filaments have a disadvantage in that when twisted, the resultant twisted filament yarn exhibits a poor utilization of tenacity and this tenacity utilization significantly decreases with an increase in the twist number thereof. Therefore, the excellent dynamic performance, for example, the high tenacity of the aromatic polyamide filament yarns is not sufficiently utilized for practical use because of poor utilization of the tenacity and poor resistance to fatigue. The main reasons for the above-mentioned disadvantages have not yet been made sufficiently clear. Nevertheless, it is assumed for the main reasons that since the aromatic polyamide filaments have a relatively low stretchability, a large stress derived from the deformation of the filaments when twisted, is created; since the high molecular chains are hard, the filaments exhibit a high rigidity modulus; and the surface friction between the filaments which is a surface property of the filaments is high.

Accordingly, to develop the utilization of cords having a high twist number in a practical use in which a high impact strength is required, there is a strong demand for aromatic polyamide filaments having a high utilization of tenacity thereof even when twisted.

In conventional means for enhancing the tenacity of the twisted aromatic polyamide filament yarns, an attempt was made to reduce the friction between the filaments by applying a surface treatment, an oiling agent or a surface coating to the filaments.

It is known that the tenacity utilization of the twisted filament yarns can be slightly enhanced by controlling the composition, application procedures and amounts of the oiling agent as disclosed in Japanese Unexamined Patent Publication (Kokai) No. 2-216,276. However, the processability and workability including a rubber-adhering property, of the resultant products have not yet reached a satisfactory level.

Also, an attempt to adhere true spherical particles having a low friction to the surfaces of the filaments was made by Japanese Patent Application No. 3-191213. In this attempt, the durability of the product is not reliable. Therefore, the means for reducing the friction between the filaments by the surface treatment are not successful at the present.

DISCLOSURE OF THE INVENTION

An object of the present invention is to provide an aromatic polyamide flat filament having a low frictional coefficient between filaments, a low stress-deformation when the filament yarn is twisted, and a high tenacity-utilization when made into a cord.

The inventors of the present invention made an in-depth study of the specific relaxation of stress created on the filaments when twisted, the specific filament form which effectively prevents the reduction in tenacity by twist strain which is assumed to be derived from the high rigidity of the molecular chain, namely a specific cross-sectional profile of filament, which exhibits a low cross-sectional secondary moment, and specific conditions effective for maintaining the tenacity of individual filaments at a high level. As a result, the inventors have found that an aromatic polyamide filament having a high utilization of tenacity, even when converted to a cord having a high twist number, can be realized by imparting a specific cross-sectional profile to the filaments, and completed the present invention based on the above-mentioned discovery.

The above-mentioned object can be attained by the aromatic polyamide flat filament of the present invention which is characterized by a flatness of cross-sectional profile thereof of 1.5 to 5, an individual filament thickness of 1 denier or more but less than 50 deniers, a tensile strength of 18 g/denier or more, an ultimate elongation of 3.5% or more, and a Young's modulus of 400 g/denier or more.

BEST MODE OF CARRYING OUT THE INVENTION

The aromatic polyamide usable for forming the flat filament of the present invention, is selected from aromatic polyamides having 80 molar % or more, preferably 90 molar % or more, of recurring units represented by the following formula:

$$-NH-Ar_1-NHCO-Ar_2-CO-$$

wherein $Ar_1$ and $Ar_2$ respectively and independently from each other represent an aromatic group selected from the group represented by the following formulae:

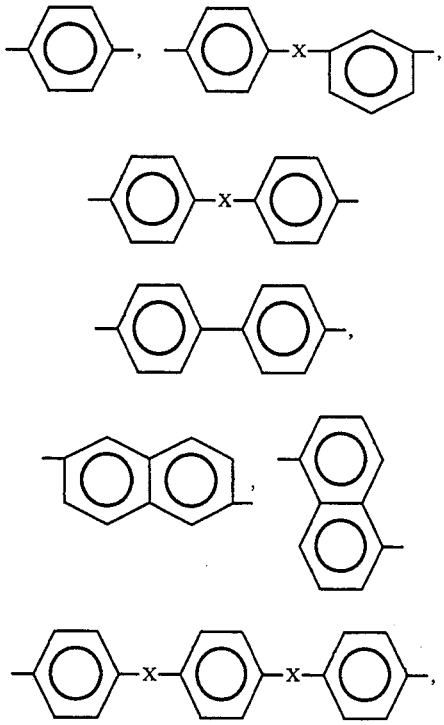

-continued and

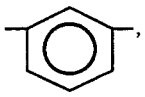

the aromatic groups optionally having at least one substituent selected from the group consisting of halogen atoms and lower alkyl groups, and X represents a member selected from divalent groups represented by the formulae:

$$-O-,\ -\underset{\underset{O}{\|}}{C}-,\ -S-,\ -\overset{\overset{O}{\|}}{\underset{\underset{O}{\|}}{S}}-,\ -CH_2-,\ \text{and}\ -CONH-.$$

The processes for producing the above-mentioned type of aromatic polyamides are disclosed in, for example, British Patent No. 1,501,948, U.S. Pat. No. 3,738,964 and Japanese Unexamined Patent Publication (Kokai) No. 49-100,322. The above-mentioned filament may contain a finishing agent, ultraviolet ray-absorber, inorganic or organic pigment and other additives.

The cross-sectional flatness of the filament of the present invention is 1.5 or more but not more than 5, preferably 2 to 3. The term "flatness" used herein refers to a ratio in length of the major axis to the minor axis of the cross-sectional profile of the filament. With respect to the cross-sectional profile of the filament of the present invention, the filament may have a smooth peripheral surface or a rough surface having a plurality of peripheral concavities and convexities. When the flatness is less than 1.5, the resultant filament exhibits an unsatisfactory reduction effect for the cross-sectional secondary moment thereof, and an insufficient utilization of tenacity of the filament when twisted. Also, if the flatness is more than 5, the resultant filament exhibits an unsatisfactory yarn-forming property and a lowered tenacity, whereas the reduction effect for the cross-sectional secondary moment of the filament is realized.

In a spinning process of high flatness filament by a semidry-semiwet spinning method (namely, a dry jet spinning method) which is a typical filament producing method for the above-mentioned polymer, the form of nozzle and the spinning draft for the filament are important. Namely, to obtain a high flatness filament, it is necessary to employ a spinning nozzle having a flatness of 2 to 10, to prevent an undesirable decrease in the flatness of the resultant filament during a coagulation and/or drawing step. When a simple rectangular slit nozzle is employed, the resultant filament takes a spindle-like cross-sectional profile at a location immediately below a spinning nozzle. This form of the cross-sectional profile has two pointed end portions and thus, the resultant filament is easily fluffed and exhibits a poor spinning property. Also, the flatness of the cross-sectional profile of the filament is easily lowered with the progress of the coagulating step and the drawing step. To eliminate the above-mentioned disadvantages, the spinning nozzle is preferably provided with a polymer sinkhole located at both the end portions or the middle portion of the slit nozzle. For example, preferably, the spinning nozzle having a specific slit in a form consisting of a plurality of circular holes connected to each other through one or more straight slits is employed, and the spinning draft (a ratio of a speed at which the coagulated filament is taken up to a speed at which a polymer dope solution is extruded through the nozzle) is controlled to a level of 5 or less, to prevent the reduction in the flatness of the resultant filament.

The flat filament of the present invention has an individual filament thickness of 1 denier or more but less than 50 deniers, preferably 1.5 to 5 deniers, when the thickness is less than 1 denier, the extrusion rate of the polymer through the spinning nozzle is low and thus the diameter of the nozzle is small. Therefore, it is difficult to work the extrusion nozzle so as to maintain the cross-sectional profile of the resultant filament in a suitable form. Also, the spinning procedure becomes unstable. Especially, when a liquid crystalline polymer is subjected to a spinning procedure in which a polymer solution with a high concentration must be employed and extruded through a spinning nozzle at a high shearing speed, the above-mentioned disadvantages are further increased.

When the thickness of the flat filament is 50 denier or more, no problem occurs in working of the spinning nozzle. However, the coagulation of the spin filamentary polymer streams sometimes becomes incomplete, and thus the following water-rinsing step and drawing step are caused to be not smooth and the properties of the resultant filament are readily deteriorated.

The flat filament of the present invention has a tensile strength of 18 g/denier, preferably 20 to 26 g/denier. It is preferred that the flat filament has as high a tensile strength as possible. However, there is a tendency for an enhancement in flatness to cause a reduction in the tensile strength of the resultant filament. Therefore, the enhancement in flatness results in a reduction in absolute mechanical strength of the resultant filament, whereas the utilization of tenacity of the filament when twisted is increased. Therefore, the inherent advantage of the aramid filament is lost.

The flat filament of the present invention has an ultimate elongation of 3.5% or more, preferably 3.5 to 4.5%. If the ultimate elongation is less than 3.5%, and the resultant filament is used as a twisted cord, the resultant twisted filament cord has a high twist stress and thus exhibits a low utilization of tenacity of the filament.

The flat filament of the present invention has a Young's modulus of 450 g/denier or more, preferably 400 to 600 g/denier. When the Young's modulus is less than 450 g/denier, the resultant filament does not exhibit the advantage of the aromatic polyamide filament as a high Young's modulus filament.

The aramid flat filament of the present invention can exhibit a high tenacity as a specific advantage thereof even when highly twisted to provide a cord. Also, in a field in which a high impact strength is required, the product from the aramide filament of the present invention can exhibit greatly enhanced performance.

The cross-sectional secondary moment of the flat filament is represented, when approximated by a cross-sectional secondary moment of an ellipse or rectangle, by $$I=\pi b^3.a/4$$

wherein 2b is a length of the minor axis of the ellipse, 2a is a length of the major axis of the ellipse, or $$I=b^3.h/12$$

wherein b is the length of a minor side of the rectangle and h is the length of a major side of the rectangle.

In a filament having a circular cross-sectional profile, the cross-sectional secondary moment is represented by $$I=\pi d^4/64$$

wherein d is a diameter.

Accordingly, if the cross-sectional areas (in other words, the thicknesses) are the same as each other, and the circular cross-section filament is flattened, a reduction in the cross-sectional second moment follows.

Even if the reduction seems to be small and the equation for the ellipse is applied, when the flatness is 2, the ratio in cross-sectional secondary moment of the flat filament to the corresponding circular cross section filament becomes about 0.5; when the flatness is 3, the cross-sectional secondary moment ratio is reduced to about 0.3. When the flatness is 4 or more, the cross-sectional secondary moment is significantly reduced and thus the flat filament exhibits a high flexibility.

When the cross-sectional secondary moment is low, and the resultant flat filament bundle is twisted, the individual filaments are smoothly braided and incurvated, and thus the twist can be effected uniformly. Therefore, it is assumed that the utilization of tenacity in the twisted flat filament yarn is increased for the above-mentioned reasons.

Generally, the yarns comprising the aromatic polyamide flat filaments of the present invention are preferably twisted yarns having a twist number of 2 turns/m or more, more preferably 2 to 8 turns/m.

EXAMPLES

The present invention will be further explained by the following examples.

(1) The polymer solution (dope) used in the examples was prepared by the following solution polymerization method.

Preparation of Dope

A mixing vessel equipped with anchor-shaped stirring wings was charged with 205 liters of N-methyl-2-pyrrolidone (which will be referred to as NMP hereinafter) having a water content of about 20 ppm and then 2764 g of p-phenylene-diamine and 5114 g of 3,4'-diamino-diphenylether, which were accurately weighed, were mixed with and dissolved in NMP, while flowing a nitrogen gas through the vessel.

Then, the diamine solution was mixed with terephthalic acid chloride in an accurately weighed amount of 10320 g at a temperature of 30° C. at a stir-revolution number of 64 turns/min. After the temperature of the solution was raised to 53° C. by the reaction heat, the reaction temperature was raised to 85° C. by a heating operation over a time of 60 minutes. The solution was further stirred at 85° C. for 15 minutes. When the viscosity of the solution rose, the polymerization reaction was stopped.

Thereafter, the polymer solution was mixed with 16.8 kg of a slurry of calcium hydroxide in a content of 22.5% by weight in NMP, and the mixture was stirred for 20 minutes to adjust the pH of the mixture to 5.4.

The neutralized polymer solution was filtered through a filter having 20 μm size openings. A polymer solution, which will be referred to as a dope hereinafter, having a polymer concentration of 6% by weight was obtained.

(2) The flatness of the cross-sectional profile of the filaments was determined by the following method.

The photograph of the cross-sections of a plurality of the filaments was prepared at a magnification of 100. With respect to the cross-sectional profiles of 50 individual filaments, an average ratio in length of the major (longest) axes to the minor (shortest) axes intersecting the major axes at a right angle thereto was determined.

The above-mentioned measurement procedures were repeated 10 times, and an average value of the measured major axis/minor axis length average ratios was obtained. The flatness of the filaments were represented by the above-mentioned average value.

EXAMPLE 1

By using the dope solution prepared by the above-mentioned polymerization process, flat filaments were produced by the following method.

The dope solution was extruded in accordance with a dry jet spinning method through a spinneret having 267 nozzles each having a slit with a width of 0.08 mm and a length of 0.3 mm and two circular holes connected to the two ends of the slit and having a diameter of 0.18 mm, at an extruding rate of 1350 g and at a dope temperature of 107° C. The extruded filamentary streams of the dope solution were coagulated in an aqueous solution containing 30% by weight of NMP at 50° C., and the resultant coagulated filaments were taken up from the coagulation bath at a spinning velocity of 47 m/min. Then, the filaments were rinsed with water and heat-drawn, and the resultant product was wound up at a velocity of 500 m/min. A filament yarn having a total thickness of 1502 deniers was obtained.

The properties of the aramid filament yarn were as follows.

Flatness of filaments: 2.6
Thickness: 1502 deniers/267 filaments
Tensile strength: 21.7 g/denier
Ultimate elongation: 3.87%
Young's modulus: 606 g/denier

EXAMPLE 2

Aramid flat filaments were produced in the same manner as in Example 1, except that each nozzle had a cross-sectional profile in which four circular openings having a diameter of 0.18 mm were connected to each other through straight slits with a width of 0.08 mm and a length of 0.3 mm, and the spinneret had 267 nozzles. Also, the extruding rate was 1600 g/min, the spinning velocity was 38 m/min and the resultant filaments were drawn at a draw ratio of 10.5 and wound up.

The resultant aramid filaments had the following properties.

Flatness of filament: 3.9
Thickness: 2248 deniers/267 filaments
Tensile strength: 21.9 g/denier
Ultimate elongation: 3.65%
Young's modulus: 600 g/denier

EXAMPLE 3

Aramid filaments were produced in the same manner as in Example 2, except that the spinneret had 50 nozzles, and filaments were produced at an extruding rate of 1200 g/min, a spinning velocity of 30 m/m and a draw ratio of 9.8. The properties of the resultant filaments were as follows.

Flatness of filaments: 4.6
Thickness: 2250 deniers/50 filaments
Tensile strength: 18.7 g/denier
Ultimate elongation: 3.52%
Young's modulus: 614 g/denier

EXAMPLE 4

Aramid filaments were produced in the same manner as in Example 1, except that the nozzle hole had a similar figure to that of Example 1 and reduced dimensions corresponding to $\frac{2}{3}$ of that of Example 1, and the spinneret had 1000 nozzle holes.

The resultant filaments had the following properties.
Flatness of filaments: 2.1
Thickness: 1498 deniers/1000 filaments
Tensile strength: 25.8 g/denier
Ultimate elongation: 4.34%
Young's modulus: 592 g/denier

COMPARATIVE EXAMPLE 1

Aramid filaments having a circular cross-sectional profile were produced in the same manner as in Example 1.

The spinneret had 267 circular nozzle holes each having a diameter of 0.3 mm and a land length of 0.45 mm.

The resultant filaments had the following properties.
Flatness of filaments: 1.17
Thickness: 1500 deniers/267 filaments
Tensile strength: 27.2 g/denier
Ultimate elongation: 4.55%
Young's modulus: 593 g/denier

COMPARATIVE EXAMPLE 2

Aramid filaments with a circular cross-sectional profile were produced in the same manner as in Example 1, except that the spinneret had 1000 nozzle holes each having a diameter of 0.3 mm and a land length of 0.45 mm.

The resultant filaments had the following properties.
Flatness of filaments: 1.05
Thickness: 1504 deniers/1000 filaments
Tensile strength: 28.9 g/denier
Ultimate elongation: 4.88%
Young's modulus: 599 denier

COMPARATIVE EXAMPLE 3

Aramid filaments were produced in the same manner as in Example 1, except that the spinneret had 50 nozzle holes each having the same form as that of the nozzle holes mentioned in Example 1, and the filaments were produced at an extruding rate of 1400 g/min, at a spinning velocity of 27 m/min and at a draw ratio of 8.8.

The resultant filaments had the following properties.
Flatness of filaments: 2.6
Thickness: 3150 deniers/50 filaments
Tensile strength: 11.7 g/denier
Ultimate elongation: 2.96%
Young's modulus: 614 g/denier However, the coagulated filaments were often wound around coagulating rolls and thus, it was difficult to continuously operate.

COMPARATIVE EXAMPLE 4

Aramid filaments were produced in the same manner as in Example 1, except that the spinneret had 267 nozzle holes each consisting of 4 circular holes having a diameter of 0.18 mm and connected to each other through straight slits having a width of 0.08 mm and a length of 0.6 mm, the extruding rate was 1600 g/min, and the spinning velocity was 38 m/min. In this comparative example, it was intended to produce filaments having a flatness of more than 5.

However, the coagulated filaments were often split and wound around rolls, and thus it was difficult to continuously operate.

EXAMPLE 5

Each of the aramid filament single yarns produced in Examples 1 and 4 and Comparative Examples 1 and 2 was twisted at a twist coefficient from 1 to 4 and the utilization of tenacity and frictional coefficient between filaments of the twisted yarn were determined.

The results are shown in Table 1.

In view of Table 1, the tenacity utilization of the flat filaments in the twisting step is higher than that of the regular filaments having a circular cross-sectional profile. This effect is deemed to be derived from the specific properties of the flat filaments that the frictional coefficient between filaments is low, and thus the twist deformation stress is low, because the cross-sectional secondary moment is low.

The tensile strength and the frictional coefficient between filaments were measured by the following methods.

| (1) Tensile strength | |
|---|---|
| Tester | Intesco Type 2001 |
| Clamp | Intesco Type 4D |
| Specimen length | 250 mm |
| Stretching velocity | 100 m/min |
| Atmosphere | 23° C., 65% RH |
| Test number | 10 |
| **(2) Frictional coefficient between filaments** | |
| Tester | Rothschild Type R-1182 |
| Twist contact of filaments | One turn (contact angle 180 degrees) |
| Filament feed tension | 0.2 g/denier |
| Test time | 5 seconds or more |
| Atmosphere | 23° C., 65% RH |
| Test number | 5 |

TABLE 1

| Item Type of aramid filament yarn | Tensile strength (kg) [Tenacity utilization (%)] Twist coefficient 1 | 2 | 3 | 4 | Frictional coefficient between filaments (at a velocity of 50 m/min) |
|---|---|---|---|---|---|
| Example 1 | 32.6 | 34.2 (105) | 26.4 (81) | 23.1 (71) | 0.03 |
| Example 4 | 38.6 | 40.9 (106) | 34.7 (90) | 31.7 (82) | 0.04 |
| Comparative Example 1 | 40.8 | 32.2 (79) | 24.5 (60) | 19.6 (48) | 0.06 |
| Comparative Example 2 | 43.5 | 37.1 (85) | 28.4 (65) | 23.1 (53) | 0.07 |

EXAMPLE 6 AND COMPARATIVE EXAMPLE 5

In Example 6, the aramid flat filament yarns produced by the method of Example 1 (thickness: 1970 denier/267 filaments, flatness of cross-sectional profile of filaments: 2.1) were doubled and twisted to provide a cord. The first twist was an S twist and the final twist was a Z twist. The twist numbers in the first and final twists are shown in Table 2.

Also, the tensile strength and the utilization in tenacity of the filaments are shown in Table 2.

In Comparative Example 5, an twisted filament yarn was produced by the same procedures as in Example 6 except that in the production of aramid filaments, the spinning nozzle holes had a circular cross-sectional profile.

The results are shown in Table 2.

TABLE 2

| Item Example No. | Cross-sectional profile of filament | Tensile strength of individual filament | Doubled, twisted filament yarn: Twist number (turn/10 cm) First twist | Final twist | Tensile strength (kg) | Utilization in tenacity (%) |
|---|---|---|---|---|---|---|
| Example 6 | Flat (*)1 | 42.1 | $10^Z$ | $10^S$ | 96.4 | 114 |
| | | | $20^Z$ | $20^S$ | 87.2 | 104 |
| | | | $30^Z$ | $30^S$ | 63.3 | 75 |
| | | | $40^Z$ | $40^S$ | 40.8 | 49 |
| Comparative Example 5 | Circle | 53.0 | $10^Z$ | $10^S$ | 105.0 | 99 |
| | | | $20^Z$ | $20^S$ | 93.5 | 88 |
| | | | $30^Z$ | $30^S$ | 65.6 | 62 |
| | | | $40^Z$ | $40^S$ | 39.0 | 37 |

Note:
(*)1 ... Cross-sectional flatness: 2.1

EXAMPLE 7 AND COMPARATIVE EXAMPLE 6

In Example 7 and Comparative Example 6, the twisted filament yarns described in Example 6 and Comparative Example 5 were subjected to the following treatments.

To prepare a first treating liquid 3.0 g of a sorbitol glycidylether compound (trademark: Deconal EX-611, made by Nagase Kasei K.K.) was mixed with 2.5 g of an aqueous dispersion of 30% of sodium dioctylsulfosuccinate (trademark: Neocol SW-30, Daiichi Kogyo Seiyaku K.K.) and the mixture was fully stirred. Next, the liquid mixture was added to 734 g of water, and the resultant mixture was stirred by using a homomixer. To the resultant mixture, 48 g of an aqueous dispersion of 25% of blocked polyisocyanate compound (trademark: S-3, made by Meisei Kagaku Kogyo K.K.) was gradually added, and the resultant mixture was fully mix-stirred. Finally, the resultant liquid mixture was added to 212.5 g of an aqueous emulsion of 40% of vinyl pyridine-styrene-butadiene terpolymer latex (trademark: Nippol 2518GL, made by Nihon Zeon K.K.) and the mixture was fully stirred.

Separately, a second treating agent was prepared by the following procedures.

An aqueous solution of 10% of sodium hydroxide in an amount of 10 g and an aqueous solution of 28% of ammonia in an amount of 30 g were added to 260 g of water, and the resultant mixture was fully stirred. To the resultant aqueous solution, 60 g of a resorcinol-formaldehyde initial condensation product (40% acetone solution) prepared by a reaction using an acidic catalyst was added, and the resultant mixture was fully stirred to provide a dispersion. Separately, 340 g of an aqueous emulsion of 40% of a vinyl pyridine-styrene-butadiene terpolymer latex (trademark: Nippol 2518GL, made by Nihon Zeon K.K.) were diluted with 200 g of water. To this diluted emulsion, the above-mentioned resorcinol-formaldehyde initial condensation product dispersion was gradually added while stirring, and then 20 g of an aqueous solution of 37% of formaldehyde were added. The resultant mixture was uniformly mixed.

The twisted filament yarn, namely cord, to be tested was treated with the first treating agent by using a dipping machine to an extent such that the dry amount of the first treating agent adhered to the filament yarn becomes 8% based on the amount of the cord, dried at 130° C. for 90 seconds, and heat treated at 240° C. for 60 seconds.

The resultant cord was subjected to the same dipping treatment as mentioned above except that the second treating liquid was used in place of the first treating liquid, the drying was carried out at 130° C. for 90 seconds and the heat treatment was carried out at 235° C. for 60 seconds.

The twist numbers, tensile strengths and utilizations in tenacity of the resultant resin-treated, doubled, twisted filament yarns are shown in Table 3.

TABLE 3

| Item Example No. | Resin-treated, doubled, twisted yarn: Twist number (turn/10 cm) First twist | Final twist | Tensile strength (kg) | Utilization in tenacity (%) |
|---|---|---|---|---|
| Example 7 | $10^Z$ | $10^S$ | 97.5 | 116 |
| | $20^Z$ | $20^S$ | 89.1 | 106 |
| | $30^Z$ | $30^S$ | 64.2 | 77 |
| | $40^Z$ | $40^S$ | 42.1 | 50 |
| Comparative Example 6 | $10^Z$ | $10^S$ | 100.4 | 95 |
| | $20^Z$ | $20^S$ | 93.1 | 88 |
| | $30^Z$ | $30^S$ | 66.9 | 63 |
| | $40^Z$ | $40^S$ | 39.2 | 37 |

EXAMPLE 8

Aramid filaments were produced from the same dope solution as in Example 1 except that 2764 g of p-phenylenediamine were replaced by a mixture of 2073 g of p-phenylenedi amine and 1421 g of 4,4'-diaminobenzanilide, under the following spinning conditions.

The spinning procedures were carried out by a dry jet spinning method. The cross-sectional profile of the nozzle holes consisted of a straight slit having a width of 0.08 mm and a length of 0.3 mm and two circular openings located at the ends of the slit and having a diameter of 0.18 mm. The spinneret had 267 nozzle holes.

The spinning procedures were carried out at an extruding rate of 1350 g and at a dope temperature of 107° C. The extruded filamentary streams of the dope solution were coagulated in an aqueous solution of 30% of NMP at a temperature of 50° C., and the coagulated filaments were withdrawn from the coagulating bath at a spinning velocity of 47 m/min, rinsed with water, and heat-drawn and then the resultant product was wound at a velocity of 500 mm/min. A filament yarn having a total thickness of 1500 deniers was obtained.

The properties of the resultant aramid filaments were as follows.

Flatness of filaments: 2.31
Thickness: 1497 denier/267 filaments
Tensile strength: 21.7 g/denier
Ultimate elongation: 3.8%
Young's modulus: 587 g/denier

EXAMPLE 9

An aramid filament yarn was produced by using the same dope solution as in Example 1 except that 2764 g of p-phenylene diamine was replaced by a mixture of 2073 g of p-phenylenediamine and 1239 g of 4,4'-diaminodiphenylmethane, under the following spinning conditions.

The spinning was carried out by a dry jet spinning method. The cross-sectional profile of the nozzle hole consisted of a straight slit with a width of 0.08 mm and a length of 0.3 mm and two circular openings connected to the ends of the slit and having a diameter of 0.18 mm. The spinneret had 267 nozzle holes.

The spinning was carried out at an extruding rate of 1350 g and at a dope temperature of 103° C. The extruded filamentary streams of the dope solution were coagulated in an aqueous solution of 30% of NMP at a temperature of 50° C.

The coagulated filaments were withdrawn from the coagulating bath at a spinning velocity of 47 m/min, rinsed with water, and heat drawn. The resultant product was wound up at a velocity of 500 m/min.

A filament yarn having a total thickness of 1500 deniers was obtained.

The aramid filaments had the following properties.

Flatness of filaments: 2.1
Thickness: 1500 deniers/267 filaments
Tensile strength: 18.7 g/denier
Ultimate elongation: 3.6%
Young's modulus: 436 g/denier

INDUSTRIAL APPLICABILITY

The aromatic polyamide flat filaments of the present invention are useful for various industrial uses, for example, ropes, hoses and belts in which twisted filament yarns high twist number are employed, because the flat filaments of the present invention exhibits a high utilization in tenacity when twisted, in comparison with conventional regular filaments with a circular cross-sectional profile.

We claim:

1. An aromatic polyamide filament having a cross-sectional profile wherein the ratio of the major axis to the minor axis is 1.5 to 5, thereby providing a flattened configuration, and having an individual filament thickness of 1 denier or more but less than 50 deniers, a tensile strength of 18 g/denier or more, an ultimate elongation of 3.5% or more and a Young's modulus of 400 g/denier or more.

2. A yarn consisting of a plurality of the aromatic polyamide flat filaments as claimed in claim 1.

* * * * *